US006004109A

United States Patent [19]

Gebele et al.

[11] Patent Number: 6,004,109

[45] Date of Patent: Dec. 21, 1999

[54] APPARATUS FOR THE RAPID EVACUATION OF A VACUUM CHAMBER

[75] Inventors: Thomas Gebele, Freigericht; Wolfgang Buschbeck, Hanau, both of Germany

[73] Assignee: Balzers und Leybold Deutschland Holding AG, Germany

[21] Appl. No.: 08/674,535

[22] Filed: Jul. 2, 1996

[30] Foreign Application Priority Data

Jul. 6, 1995 [DE] Germany ..... 195 24 609

[51] Int. Cl.[6] ..... F04B 23/08; F04C 25/02

[52] U.S. Cl. ..... 417/243; 417/205

[58] Field of Search ..... 417/243, 205, 417/248, 250, 252, 302

[56] References Cited

U.S. PATENT DOCUMENTS

| | | | |
|---|---|---|---|
| 2,652,188 | 9/1953 | Cyr | 230/2 |
| 4,505,647 | 3/1985 | Alloca et al. | 417/252 |
| 4,850,806 | 7/1989 | Morgan et al. | 417/205 |
| 5,039,280 | 8/1991 | Saulgeot | 417/205 |
| 5,228,838 | 7/1993 | Gebele et al. | 417/250 |
| 5,259,735 | 11/1993 | Takahashi et al. | 417/203 |
| 5,595,477 | 1/1997 | Amlinger | 417/205 X |

FOREIGN PATENT DOCUMENTS

| | | |
|---|---|---|
| 541989 | 5/1993 | European Pat. Off. . |
| 96304 | 3/1973 | German Dem. Rep. . |
| 118144 | 2/1976 | German Dem. Rep. . |
| 200534 | 5/1983 | German Dem. Rep. . |
| 1024668 | 2/1958 | Germany . |
| 1114981 | 10/1961 | Germany . |

OTHER PUBLICATIONS

Füssel, "Trockenlanferde Vakuurmprempen in der Chemischen Industrie" Vakuum in der Praxis, No. 2, pp. 85–88.

*Primary Examiner*—Ismael Izaguirre
*Attorney, Agent, or Firm*—Fulbright & Jaworski, LLP

[57] ABSTRACT

A first vacuum pump (14) is connected to a vacuum chamber (5) by a primary intake line (13) having a first vacuum valve (4) therein. A second vacuum pump (15) is connected to the output of the first vacuum pump (14) by a connecting line (20) having a second vacuum valve (12) therein. A blowout valve (17) is connected to the connecting line (20) between the first pump (14) and the second valve (12). A secondary intake line (19) having therein a third vacuum valve (13) is connected between the vacuum chamber (5) and the intake of the second vacuum pump (15).

4 Claims, 3 Drawing Sheets

APPARATUS FOR THE RAPID EVACUATION OF A VACUUM CHAMBER

BACKGROUND OF THE INVENTION

The invention pertains to an apparatus for the rapid evacuation of a vacuum chamber by means of a first vacuum pump, preferably a Roots vacuum pump, and an intake line with a first shut-off valve connecting the intake port of this first pump to the vacuum chamber. A second vacuum pump is installed downline of the first pump by means of a connecting line. A bypass line connects the working chamber of the first vacuum pump to the connecting line and brings about a preintake cooling function. A blow-out valve is installed in this connecting line.

For the rapid evacuation of large volumes, pump stands with preintake-cooled Roots vacuum pumps are frequently used. In chambers which are to be evacuated to the pressure range below 200 mbars, multi-stage pump stations have been found useful. It is known that a Roots vacuum pump can be used as the largest pump connected directly to the vacuum chamber and that the following pump stage can be any desired combination of preintake-cooled Roots vacuum pumps and/or other pumps. For the evacuation process, the largest preintake-cooled Roots vacuum pump is connected to the vacuum chamber. Thus a powerful suction capacity is achieved starting right at atmospheric pressure. As a result of this method, the downline (smaller) pumps can no longer transport the quantity of gas conveyed by the first pump once the pressure falls below atmospheric pressure. To prevent the buildup of an undesirable positive pressure in this case, a blow-out valve leading to the outside is usually installed between the first and the second pump stage. Depending on the staging of the selected pumps, a transition pressure is obtained, from which pressure on the blow-out valve is closed, because the fore-pumps are now able to convey the mass flow conveyed by the first stage in the negative pressure range. The fore-pump stand has an effect on the total suction capacity only below the transition pressure. At higher pressures, the fore-pump stand therefore remains unused.

SUMMARY OF THE INVENTION

The object of the present invention is to connect the main pump and the fore-pump to each other in such a way that the pumping time can be reduced. This is accomplished by a second valve in the connecting line and a secondary intake line connected between the vacuum chamber and the intake port of the second pump, which line is provided with a third shutoff valve.

DETAILED DESCRIPTION OF THE PREFERRED EMBODIMENT

Figure 1:
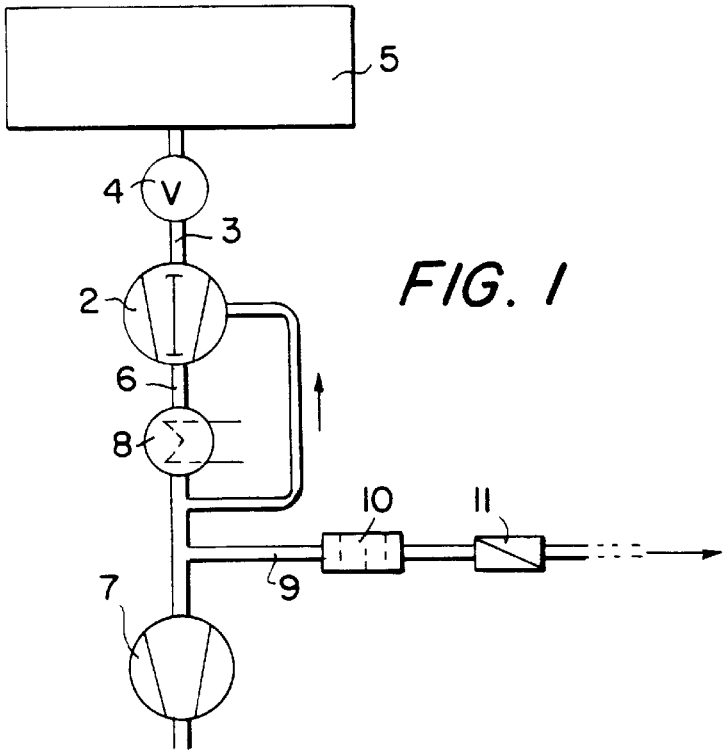
FIG. 1 shows a device with main pump and fore-pump according to the prior art.

In the prior art apparatus shown in FIG. 1, the main pump is preferably a Roots vacuum pump 2, and is connected to vacuum chamber 5 by way of an intake port 3 in which shut-off valve 4 is installed. The output port of pump 2 is connected by way of a connecting line 6 to a fore-pump 7. A preintake cooler 8 is also installed in connecting line 6, and a noise suppressor 10 and a blow-out valve 11 are installed in a branch line 9. For the purpose of preventing pump 2 from becoming overheated, it is possible to return the gaseous medium which has been cooled in preintake cooler 8 back to pump 2 by a pre-intake line 18 (this line is optional). Because the two pumps 2, 7 are connected in series, fore-pump 7 has no effect on the process at the beginning of the evacuation operation.

Figure 2:
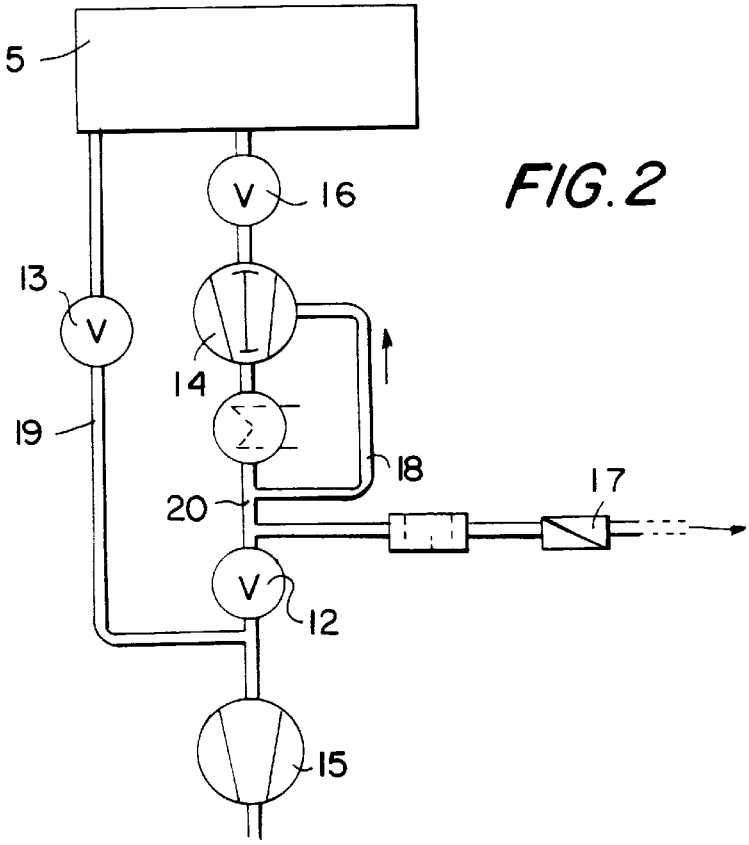
FIG. 2 shows a device according to the invention with pumps which can be connected either in series or in parallel.

Referring to FIG. 2, the goal of the invention is to take advantage of the suction capacity of fore-pump 15 for the evacuation operation even at pressures which are above the transition pressure. This is accomplished by means of secondary line 19 and additional valves 12, 13. As a result, it is possible to connect the fore-pump stand directly to vacuum vessel 5 at pressures which are above the transition pressure, i.e., pressures at which the fore-pump stand normally has no function because of blow-out valve 11, 17. During this period of time, both the suction capacity of pump 2, 14 and the suction capacity of fore-pump stand 7, 15 are available.

Pump Sequence

For pumping, first valve 16 and third valve 13 are opened simultaneously, whereas second valve 12 is kept closed. First pump 14 and second pump 15 evacuate vacuum chamber 5 in parallel. The suction capacity is:

$$S=S(\mathbf{14})+S(\mathbf{15})$$

First pump 14 blows the required amount of gas directly through blow-out valve 17 into the atmosphere.

At a suitably selected pressure below the transition pressure, valve 13 installed in secondary line 19 is closed, and valve 12 installed in connecting line 20 is opened. Second pump 15 now serves as fore-pump for first pump 14 and conveys the entire gas stream drawn by pump 14.

As a result of the measures described here, it is possible to reduce the pumping time by 10–15% without any additional pumps, the exact degree of reduction depending on the staging of the pumps and the desired final pressure.

Figure 3A:
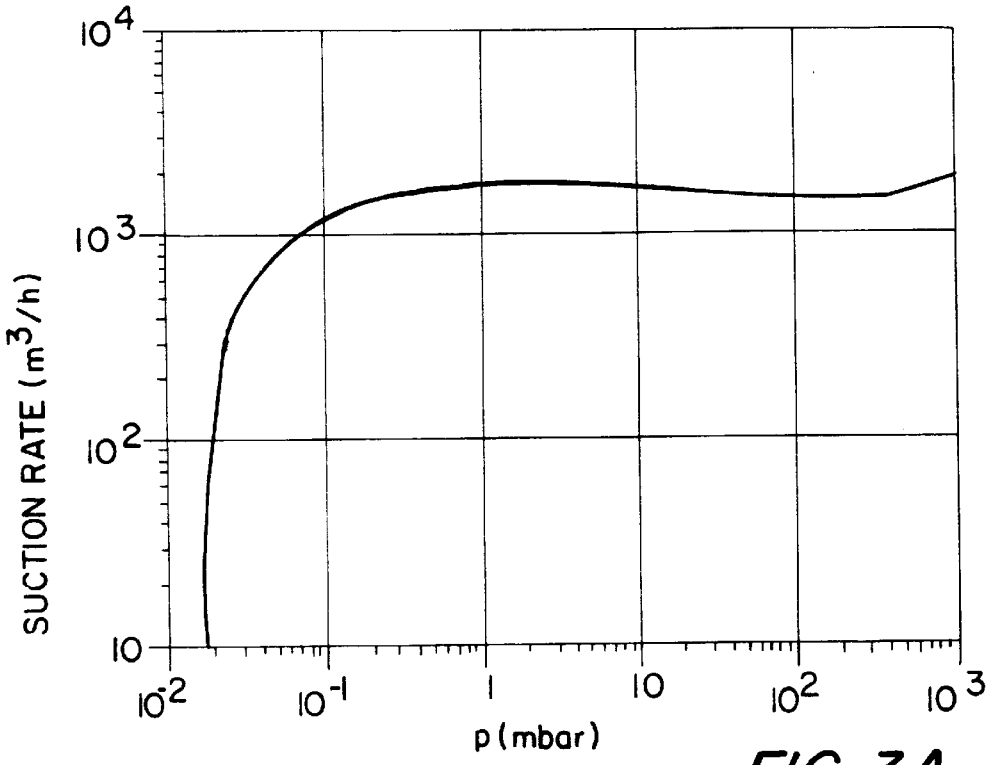
FIG. 3A (PRIOR ART)
FIG. 3A is a plot of the suction rate versus vacuum chamber pressure according to the prior art.
Figure 3B:
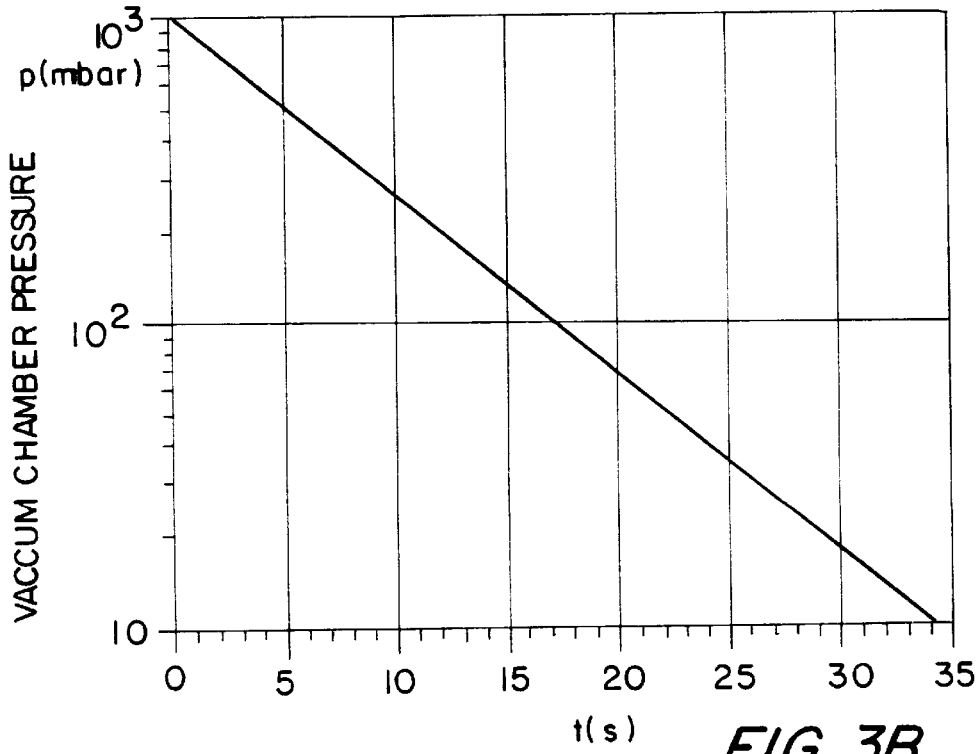
FIG. 3B (PRIOR ART)
FIG. 3B is a plot of the vacuum chamber pressure versus time according to the prior art.

FIG. 3A is a plot of the actual suction rate versus pressure which was observed for the prior art apparatus of FIG. 1; the volume of the vacuum chamber was 2.3 $m^3$. FIG. 3B is the corresponding plot of pressure versus time. The time required to pump the chamber from 1000 mbar down to 10 mbar was 34.3 seconds.

Figure 4A:
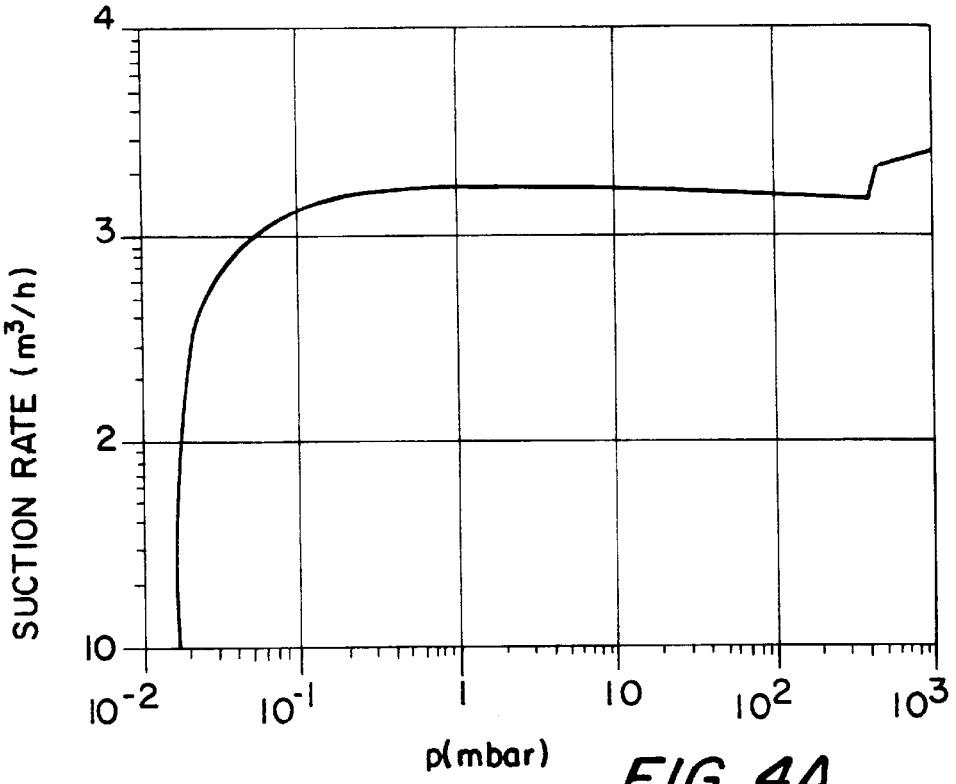
FIG. 4A is a plot of the suction rate versus vacuum chamber pressure according to the present invention.
Figure 4B:
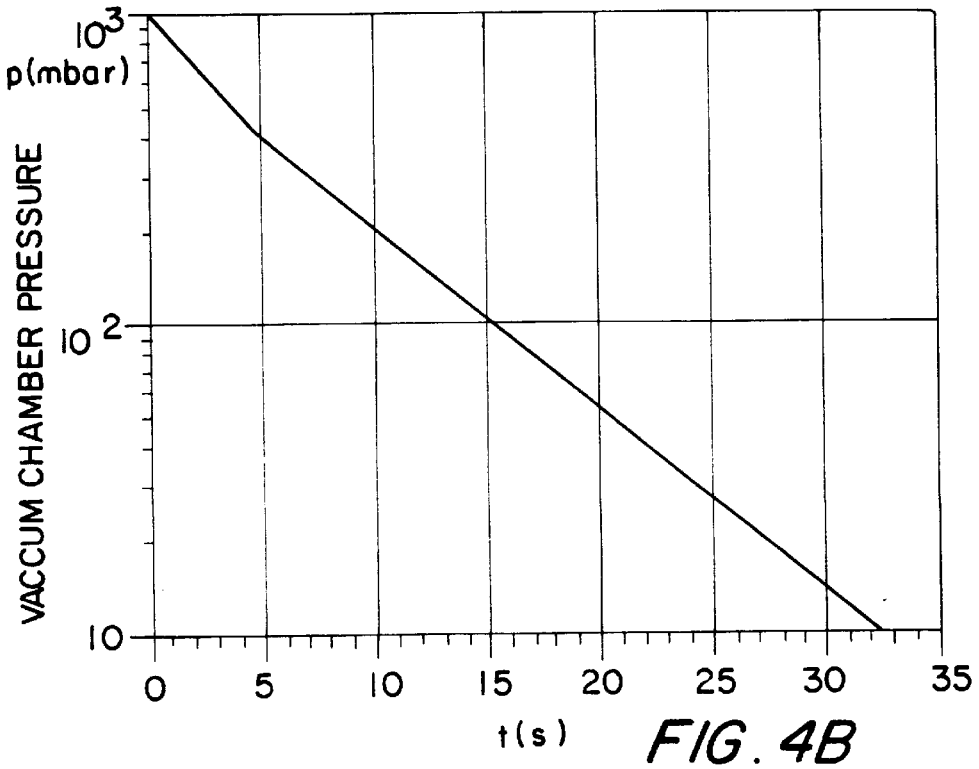
FIG. 4B is a plot of the vacuum chamber pressure versus time according to the present invention.

FIG. 4A is a plot of the actual suction rate versus pressure which was observed for the inventive apparatus of FIG. 2, following the procedure outlined above. FIG. 4B is the corresponding plot of pressure versus time. The time required to pump the chamber from 1000 mbar down to 10 mbar was 31.5 seconds, which represents an 8.2% reduction in pumping time.

What is claimed is:

1. Apparatus for evacuating a vacuum chamber, said apparatus comprising a first vacuum pump having an intake port, a working chamber, and an output port, said intake port being connected to said vacuum chamber by a first intake line through which gas is withdrawn from the vacuum chamber, a first vacuum valve installed in said first intake line, said first vacuum valve selectively permitting and blocking flow of gas through said first intake line, a second vacuum pump having an intake port connected to said output port of said first pump by a connecting line, a second vacuum valve installed in said connecting line between said first vacuum pump and said second vacuum pump, a blow-out valve connected to said connecting line between said first vacuum pump and said second vacuum valve, a secondary intake line connected to the intake port of the second vacuum pump and to the vacuum chamber, and a third vacuum valve installed in said secondary intake line, and selectively permitting and blocking gas flow between the vacuum chamber and the second vacuum pump.

2. Apparatus as in claim 1 wherein said first vacuum pump is a Roots pump.

3. Apparatus as in claim 1 further comprising a bypass line connecting said connecting line to said working chamber of said first vacuum pump, said bypass line being connected to said connecting line between said output port of said first pump and said second vacuum valve.

4. Apparatus as in claim 3 further comprising cooling means in said connecting line between said output port of said first vacuum pump and said connection to said connecting line.

* * * * *